United States Patent [19]

Stevens

[11] Patent Number: 5,048,714

[45] Date of Patent: Sep. 17, 1991

[54] COVER FOR AN OPEN-TOPPED RECEPTACLE

[75] Inventor: James W. Stevens, Rensselaer, N.Y.

[73] Assignee: The Vollrath Company, Inc., Sheboygan, Wis.

[21] Appl. No.: 523,582

[22] Filed: May 15, 1990

[51] Int. Cl.[5] ..... B65D 51/02; A47J 36/06

[52] U.S. Cl. ..... 220/287; 220/352; 220/356; 220/355; 220/380

[58] Field of Search ..... 220/352, 355, 356, 287, 220/380, 912, 574, 354, 357, 358, 353; 206/508

[56] References Cited

U.S. PATENT DOCUMENTS

| | | | |
|---|---|---|---|
| 826,292 | 7/1906 | Truxall | 206/508 |
| 2,606,586 | 8/1952 | Hill | 220/356 |
| 3,056,525 | 10/1962 | Deinert | 220/356 |
| 4,163,503 | 8/1979 | McKinnon | 220/287 X |
| 4,254,891 | 3/1981 | Jeppsson | 220/355 |
| 4,286,713 | 9/1981 | Marchais | 220/352 X |
| 4,412,630 | 11/1983 | Daenen | 220/355 |
| 4,742,933 | 5/1988 | Panick | 220/355 X |

*Primary Examiner*—Stephen Marcus
*Assistant Examiner*—Paul Schwarz
*Attorney, Agent, or Firm*—Foley & Lardner

[57] ABSTRACT

A cover for an open-topped receptacle, which receptacle is generally rectangular and has a peripheral prominence. In its preferred embodiment, the cover comprises a substantially planar central web bounded by an integral channel which is generally registrable with the peripheral prominence of the receptacle. The channel is configured to effect nested reception of the peripheral prominence within the channel. The channel has a width and comprises four channel segments and four corners. Each of the corners is established substantially at an intersection of a respective two of the channel segments and each of the corners is truncated at least the width of the channel athwart each of the respective two channel segments intersecting at the corner.

16 Claims, 2 Drawing Sheets

COVER FOR AN OPEN-TOPPED RECEPTACLE

BACKGROUND OF THE INVENTION

The present invention is directed to a cover for an open-topped receptacle. Specifically, the present invention is particularly useful for providing a cover for large rectangular open-topped receptacles of the sort extensively used in institutional food service operations.

Covers for such open-topped receptacles are known in the art, but generally suffer from certain shortcomings. For example, such receptacle covers often have a handle in the center of the cover, which handle interferes with stacking of covered receptacles, as well as interferes with stacking of the receptacle covers themselves for storage. Further, such prior art covers generally are designed to fit a particular pan size and do not readily fit pans having a somewhat different upper rim configuration, as may be presented by pans from different manufacturers.

Still further, it is often desirable that a cover be designed to cover half a pan in order that one of two covers covering a pan may be removed to allow access to the food in the pan while maintaining protection and retaining heat to some degree in the remaining covered half of the pan.

The present invention is designed to provide a cover which can overcome the above deficiencies of prior art covers and provide a stackable, accommodating cover capable of covering a portion of a receptacle.

SUMMARY OF THE INVENTION

The invention is a cover for an open-topped receptacle, which receptacle is generally rectangular and has a peripheral prominence. In its preferred embodiment, the cover comprises a substantially planar central web bounded by an integral channel which is generally registrable with the peripheral prominence of the receptacle. The channel is configured to effect nested reception of the peripheral prominence within the channel. The channel has a width and comprises four channel segments and four corners. Each of the corners is established substantially at an intersection of a respective two of the channel segments and each of the corners is truncated at least the width of the channel athwart each of the respective two channel segments intersecting at the corner.

The cover may be configured to substantially fully cover the receptacle or to cover a portion of the receptacle.

Further in its preferred embodiment, the cover is configured to allow nested stacking of covered receptacles, as well as to allow nested stacking of the covers themselves for storage.

It is, therefore, an object of the present invention to provide a cover for an open-topped receptacle which can accommodate a variety of pans from a variety of manufacturers.

A further object of the present invention is to provide a cover for an open-topped receptacle which is configured to facilitate nested stacking of covered receptacles.

Yet a further object of the present invention is to provide a cover for an open-topped receptacle which is configured to facilitate nested stacking of the covers for storage.

A still further object of the present invention is to provide a cover for an open-topped receptacle which has corners truncated sufficiently to accommodate nested reception of the cover with a pan perimeter where the pan perimeter extends beyond the edge of the cover.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
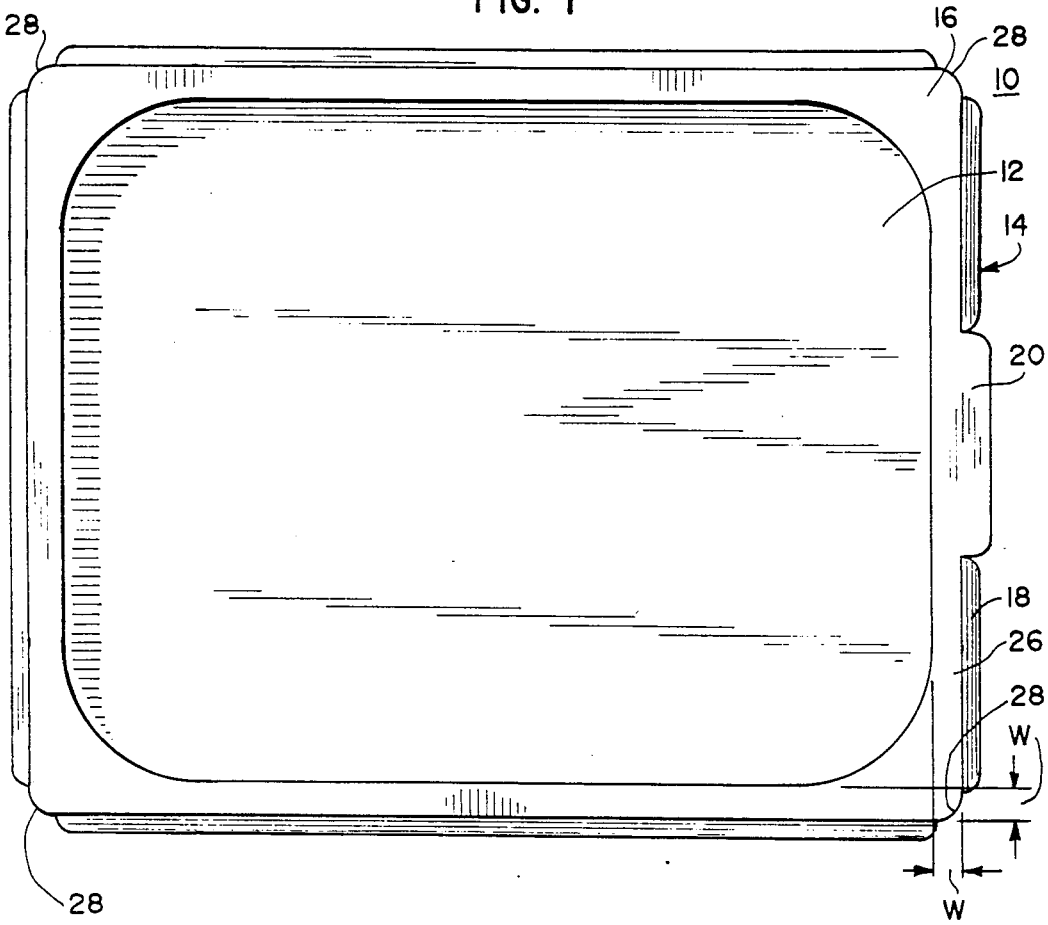
FIG. 1 is a top view of the preferred embodiment of the present invention.

FIG. 1 is a top view of the preferred embodiment of the present invention.

In FIG. 1, a cover 10 is illustrated having a substantially planar central web 12 surrounded by an edge terminus 14. Edge terminus 14 is comprised of a lip 16 with a downward depending skirt 18. At one end, an integral handle 20 is formed by material which otherwise would have been incorporated in skirt 18.

In the interest of facilitating understanding of the present invention, like elements will be referred to by like reference numerals in the various figures.

Figure 2:
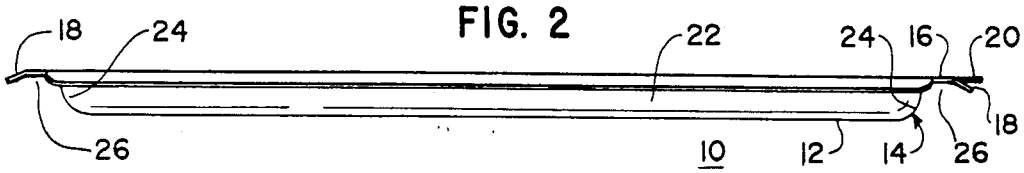
FIG. 2 is a side view of the preferred embodiment of the present invention, taken from the bottom of FIG. 1.

FIG. 2 is a side view of the preferred embodiment of the present invention. In FIG. 2, central web 12 is shown as integrally terminating in edge terminus 14 comprised of lip 16 and downward depending skirt 18. Handle 20 is clearly visible, as well, in FIG. 2. In the preferred embodiment of the present invention, central web 12 cooperates with edge terminus 14 to provide a well 22 bounded by web 12 and inner boundary 24 of edge terminus 14. Inner boundary 24 provides a stop for impeding lateral shifting of an adjacent cover in stacked relation with cover 10, as well as impeding lateral shifting of a bottom of a receptacle which may be stacked next above cover 10 in a stack of covered receptacles.

Skirt 18 and inner boundary 24 cooperate with lip 16 to establish a channel 26. Channel 26 surrounds well 12 and has a width W.

As best seen in FIG. 1, cover 10 has corners 28 which are truncated, or cut back a distance in each of two axes generally equal to width W of channel 26. Such truncation of corners 28 allows a receptacle rim, such as upper terminus 34 (FIG. 4) to be fully nested within channel 26 even though upper terminus 34 may extend beyond edge terminus 14.

Figure 3:
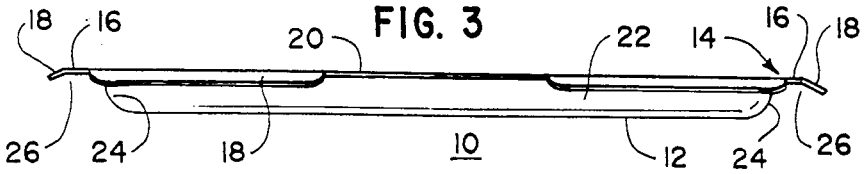
FIG. 3 is an end view of the preferred embodiment of the present invention, taken from the right side of FIG. 1.

FIG. 3 is an end view of the preferred embodiment of the present invention illustrated in FIG. 1. In FIG. 3, well 22 is illustrated as bounded by central web 12 and inner boundary 24. Depending skirt 18 is illustrated as interrupted to form handle 20. Inner boundary 24 cooperates with lip 16 and depending skirt 18 to form channel 26.

Figure 4:
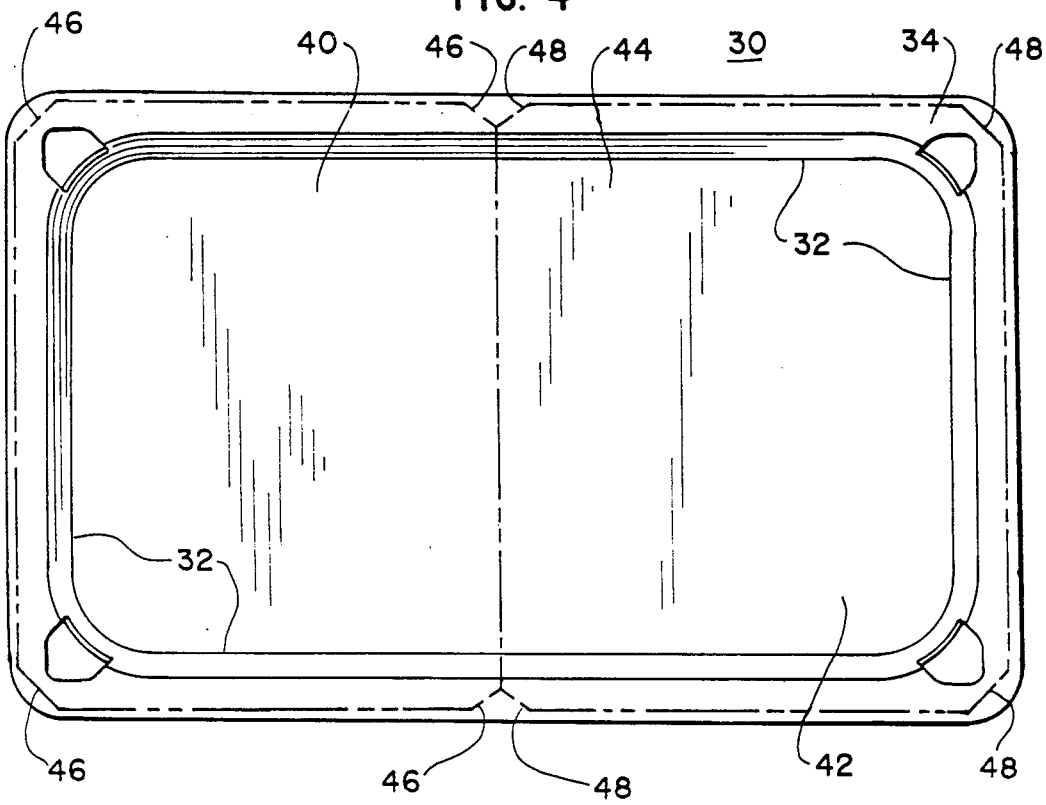
FIG. 4 is a top view of a receptacle appropriate for use with the preferred embodiment of the present invention.

FIG. 4 is a top view of a receptacle appropriately configured for use with the cover of the present invention. In FIG. 4, a receptacle 30 is illustrated having a generally rectangular shape and four walls 32 terminating in an upper terminus 34.

Figure 5:
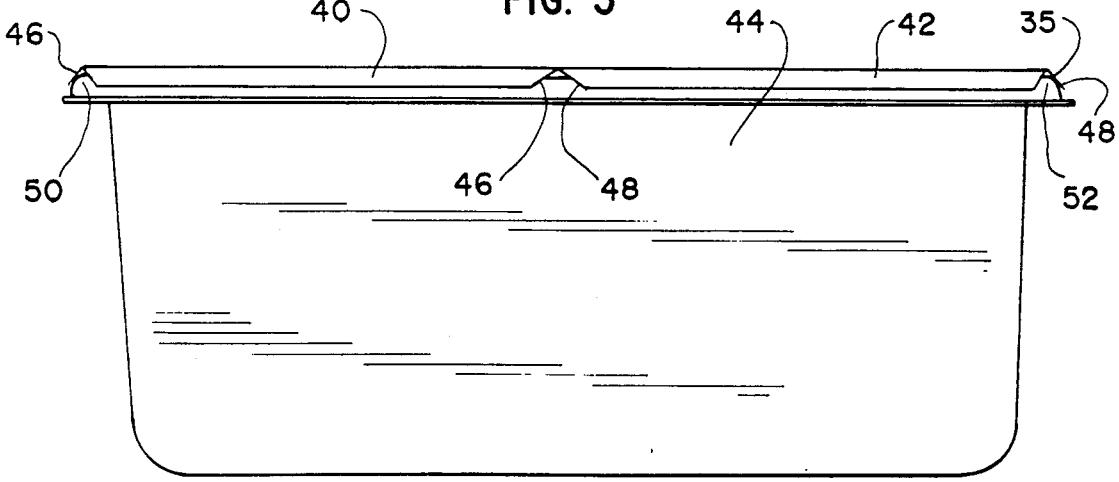
FIG. 5 is a side view of the receptacle illustrated in FIG. 4.

Referring to FIG. 5, in which a side view of the receptacle illustrated in FIG. 4 is presented, it may be seen that upper terminus 34 presents a peripheral prominence 35.

Referring to FIGS. 4 and 5, in which like elements will be identified by like reference numerals, two half-covers 40, 42 are illustrated as spanning well 44 of receptacle 30. The expanse of half-covers 40, 42 when installed on receptacle 30 is illustrated in phantom in FIG. 4. Half-cover 40 has corners 46 and half-cover 42 has corner 48. Corners 46, 48 are truncated to accommodate nested engagement of upper terminus 34 within channels 50 (half-cover 40) and 52 (half-cover 42) even though upper terminus 34 traverses half-cover 40 and half-cover 42.

Half-covers 40,42 are preferably each substantially similar in construction to cover 10 (FIGS. 1–3), except in their centrally abutting sides which traverse receptacle 30 where there is no contemplated edge terminus like edge terminus 14 of cover 10. Of course, half-covers 40,42 are intentionally dimensioned differently than cover 10 in order to effect their partial covering of receptacle 30.

By their structures, cover 10 and half covers 40,42 can accommodate slightly differing dimensions of peripheral prominence 35. This so because channel 26 is bounded by inner boundary 24 and by downward depending skirt 18. While cover 10 and half-covers 40,42 best fit a peripheral prominence which will nestingly rest within channel 26 (abutting inner boundary 24 and generally adjacent the intersection of skirt 18 and lip 16) the downward dependency of skirt 18 affords forgiveness in accommodating a somewhat broader peripheral prominence 35. Thus, cover 10 and half-covers 40,42 can fit a receptacle having such a broader peripheral prominence 35, urging peripheral prominence 35 against inner boundary 24, while firmly seating upon skirt 18 at a locus displaced outward of the intersection of skirt 18 and lip 16.

Of course, half-cover 40 and half-cover 42 could be replaced by a single cover spanning receptacle 30 without departing from the scope of the present invention.

It is to be understood that, while the detailed drawings and specific examples given describe preferred embodiments of the invention, they are for the purpose of illustration only, that the apparatus of the invention is not limited to the precise details and conditions disclosed, and that various changes may be made therein without departing from the spirit of the invention which is defined by the following claims.

I claim:

1. A cover for an open-topped receptacle, said receptacle having walls terminating in an upper terminus, said upper terminus having four segments and generally defining a first quadrilateral; the cover comprising:

a central web terminating in an edge terminus, said edge terminus being substantially circumjacent said web and presenting a channel, said channel generally defining a second quadrilateral having four corners, said channel being configured to effect nested reception with at least a portion of at least two of said segments within said channel; each of said corners being truncated appropriately to accommodate said nested reception of those of said segments which extend beyond said edge terminus outboard of said web.

2. A cover for an open-topped receptacle as recited in claim 1 wherein said channel is configured to effect said nested reception appropriate for the cover to span substantially one-half of said receptacle.

3. A cover for an open-topped receptacle as recited in claim 1 wherein said channel is configured to effect said nested reception appropriate for the cover to substantially fully cover said receptacle.

4. A cover for an open-topped receptacle as recited in claim 1 wherein said channel is configured to effect said nested reception with substantially all of each of said segments.

5. A cover for an open-topped receptacle as recited in claim 1 wherein said channel has an inner boundary adjacent said web, said inner boundary being arcuate at each of said corners.

6. A cover for an open-topped receptacle as recited in claim 5 wherein said channel is configured to effect said nested reception appropriate for the cover to span substantially one-half of said receptacle.

7. A cover for an open-topped receptacle as recited in claim 5 wherein said channel is configured to effect said nested reception appropriate for the cover to substantially fully cover said receptacle.

8. A cover for an open-topped receptacle as recited in claim 5 wherein said channel is configured to effect said nested reception with substantially all of each of said segments.

9. A cover for an open-topped receptacle as recited in claim 1 wherein said web and said edge terminus cooperate to present a stop means disposed about said web, said stop means being configured to impede lateral shifting of an adjacent receptacle resting atop the cover, thereby facilitating stacking of covered receptacles.

10. A cover for an open-topped receptacle as recited in claim 9 wherein said channel is configured to effect said nested reception appropriate for the cover to span substantially one-half of said receptacle.

11. A cover for an open-topped receptacle as recited in claim 9 wherein said channel is configured to effect said nested reception appropriate for the cover to substantially fully cover said receptacle.

12. A cover for an open-topped receptacle as recited in claim 9 wherein said channel is configured to effect said nested reception with substantially all of each of said segments.

13. A cover for an open-topped receptacle, said receptacle being generally rectangular and having a peripheral prominence; the cover comprising:

a substantially planar central web bounded by an integral channel, said channel being generally registrable with said peripheral prominence and configured to effect nested reception of said peripheral prominence;

said channel having a width and comprising four channel segments, said channel having four corners, each of said corners being established substantially at an intersection of a respective two of said channel segments;

each of said corners being truncated at least said width athwart each of said respective two of said channel segments.

14. A covering system for an open-topped receptacle, said receptacle being generally polygonal and having a peripheral prominence; the system comprising:

at least one cover, said at least one cover having a substantially planar central web partially bounded by an integral channel, said channel being generally registrable with a portion of said peripheral prominence, said channel seatingly engaging said portion with said at least one cover spanning a part of said receptacle;

said channel having a width and comprising a plurality of channel segments, said channel having a plurality of corners, each of said plurality of corners being established at an intersection of a respective two of said plurality of channel segments;

each of said corners being truncated at least said width athwart each of said respective two of said plurality of channel segments.

15. A covering system for an open-topped receptacle as recited in claim 14 wherein said at least one cover comprises a plurality of covers, said plurality of covers cooperating to substantially completely cover said receptacle.

16. A covering system for an open-topped receptacle as recited in claim 15 wherein each of said plurality of covers is of substantially the same configuration.

* * * * *